US006848504B2

(12) United States Patent
Brunet et al.

(10) Patent No.: US 6,848,504 B2
(45) Date of Patent: Feb. 1, 2005

(54) APPARATUS AND METHOD TO COMPLETE A MULTILATERAL JUNCTION

(76) Inventors: Charles G. Brunet, 1017 Nantucket, Unit D, Houston, TX (US) 77057; Michel Bouchard, P.O. Box N-7117, Nassau, N.P. (BS)

( * ) Notice: Subject to any disclaimer, the term of this patent is extended or adjusted under 35 U.S.C. 154(b) by 63 days.

(21) Appl. No.: 10/205,978

(22) Filed: Jul. 26, 2002

(65) Prior Publication Data

US 2004/0016547 A1 Jan. 29, 2004

(51) Int. Cl.[7] ..... E21B 7/08

(52) U.S. Cl. ..... 166/117.5; 166/117.6; 175/61; 175/81

(58) Field of Search ..... 166/117.5, 117.6, 166/313, 206, 207; 175/61, 81

(56) References Cited

U.S. PATENT DOCUMENTS

| | | | | | |
|---|---|---|---|---|---|
| 4,415,205 | A | | 11/1983 | Rehm et al. | 299/5 |
| 4,613,162 | A | | 9/1986 | Hughes | 285/27 |
| 5,311,936 | A | | 5/1994 | McNair et al. | 166/50 |
| 5,318,121 | A | | 6/1994 | Brockman et al. | 166/313 |
| 5,318,122 | A | | 6/1994 | Murray et al. | 166/313 |
| 5,322,127 | A | | 6/1994 | McNair et al. | 166/313 |
| 5,325,924 | A | * | 7/1994 | Bangert et al. | 166/313 |
| 5,353,876 | A | | 10/1994 | Curington et al. | 166/313 |
| 5,373,906 | A | * | 12/1994 | Braddick | 175/67 |
| 5,388,648 | A | | 2/1995 | Jordan, Jr. | 166/380 |
| 5,458,209 | A | * | 10/1995 | Hayes et al. | 175/61 |
| 5,474,131 | A | | 12/1995 | Jordan, Jr. et al. | 166/313 |
| 5,477,923 | A | | 12/1995 | Jordan, Jr. et al. | 166/313 |
| 5,477,925 | A | | 12/1995 | Trahan et al. | 166/382 |
| 5,520,252 | A | | 5/1996 | McNair | 166/313 |
| 5,615,740 | A | | 4/1997 | Comeau et al. | 166/117 |
| 5,884,698 | A | * | 3/1999 | Hughes et al. | 166/117.6 |
| 5,944,108 | A | | 8/1999 | Baugh et al. | 166/313 |
| 5,979,560 | A | | 11/1999 | Nobileau | 166/381 |
| 6,012,527 | A | * | 1/2000 | Nitis et al. | 166/313 |
| 6,041,855 | A | | 3/2000 | Nistor | 166/50 |
| 6,047,774 | A | * | 4/2000 | Allen | 166/313 |
| 6,062,306 | A | | 5/2000 | Gano et al. | 166/50 |
| 6,065,543 | A | | 5/2000 | Gano et al. | 166/378 |
| 6,079,494 | A | | 6/2000 | Longbottom et al. | 166/313 |
| 6,089,320 | A | | 7/2000 | LaGrange | 166/313 |
| 6,135,208 | A | | 10/2000 | Gano et al. | 166/313 |
| 6,158,513 | A | * | 12/2000 | Nistor et al. | 166/313 |
| 6,158,514 | A | | 12/2000 | Gano et al. | 166/313 |
| 6,186,233 | B1 | | 2/2001 | Brunet | 166/298 |

(List continued on next page.)

FOREIGN PATENT DOCUMENTS

| | | | |
|---|---|---|---|
| EP | 0859120 | 8/1998 | E21B/23/00 |
| EP | 0859121 | 8/1998 | E21B/23/00 |
| EP | 0859122 | 8/1998 | E21B/23/00 |
| EP | 0859123 | 8/1998 | E21B/23/00 |
| EP | 0859124 | 8/1998 | E21B/29/06 |
| GB | 353 812 | 8/1997 | E21B/43/30 |
| GB | 2353811 | 8/1997 | E21B/43/30 |
| GB | 2353813 | 8/1997 | E21B/29/06 |
| GB | 2353814 | 8/1997 | E21B/43/30 |

(List continued on next page.)

*Primary Examiner*—Frank Tsay

(57) ABSTRACT

An apparatus and method for connecting a lateral well bore to a vertical well bore using a tieback liner while providing full bore access in the vertical well bore casing. The tieback liner is rotationally aligned with respect to a window of the casing by locating a key slot formed above the window and longitudinally aligned by using a no-go device to locate the bottom edge of the window. The tieback liner includes a snap sleeve that extends into a window of the main well bore casing and connects the tieback liner to the casing. The section of the casing receiving the snap sleeve is of a larger inner diameter than the other sections of casing. The connection between the tieback liner and casing prevents the tieback liner from rotating, tilting, or moving laterally with respect to the casing. The connection imparts significant resistance to formation loading applied at the junction.

25 Claims, 11 Drawing Sheets

U.S. PATENT DOCUMENTS

| | | | | |
|---|---|---|---|---|
| 6,206,111 | B1 | 3/2001 | Nistor | 175/61 |
| 6,209,644 | B1 | 4/2001 | Brunet | 166/297 |
| 6,209,648 | B1 | 4/2001 | Ohmer et al. | 166/313 |
| 6,244,340 | B1 | 6/2001 | McGlothen et al. | 166/255.3 |
| 6,253,852 | B1 | 7/2001 | Nobileau | 166/313 |
| 6,279,659 | B1 | 8/2001 | Brunet | 166/313 |
| 2001/0025710 | A1 | 10/2001 | Ohmer et al. | 166/313 |
| 2002/0000319 | A1 | 1/2002 | Brunet | 166/313 |
| 2002/0011340 | A1 | 1/2002 | Murray | 166/380 |

FOREIGN PATENT DOCUMENTS

| | | | |
|---|---|---|---|
| GB | 2316424 | 2/1998 | E21B/29/06 |
| GB | 2333546 | 1/1999 | E21B/33/10 |
| GB | 2322147 | 9/1999 | E21B/43/30 |
| GB | 2327964 | 9/1999 | E21B/43/30 |
| GB | 2345 933 | 1/2000 | E21B/33/10 |
| GB | 2304764 | 2/2000 | E21B/43/30 |
| GB | 2363139 | 6/2000 | E21B/47/09 |
| GB | 2333 788 | 12/2000 | E12B/43/10 |
| GB | 2363142 | 5/2001 | E21B/43/10 |
| GB | 2368862 | 11/2001 | E21B/41/00 |
| GB | 2371579 | 1/2002 | E21B/41/00 |
| GB | 2330159 | 2/2002 | E21B/43/10 |
| GB | 2332 919 | 2/2002 | E21B/43/30 |
| WO | WO 97/07318 | 2/1997 | E21B/7/06 |
| WO | WO 97/12112 | 4/1997 | E21B/7/06 |
| WO | WO 97/12113 | 4/1997 | E21B/7/08 |
| WO | WO 98/05845 | 2/1998 | E21B/23/00 |
| WO | WO 98/53174 | 11/1998 | E21B/7/06 |
| WO | WO 99/39077 | 8/1999 | E21B/23/00 |
| WO | WO 00/26499 | 5/2000 | E21B/17/00 |
| WO | WO 00/29713 | 5/2000 | E21B/33/10 |
| WO | WO 00/63528 | 10/2000 | E21B/43/14 |
| WO | WO 01/25587 | 4/2001 | E21B/7/08 |
| WO | WO 01/29362 | 4/2001 | E21B/7/08 |
| WO | WO 01/98632 | 12/2001 | E21B/47/12 |
| WO | WO 02/02900 | 1/2002 | |
| WO | WO 02/48504 | 6/2002 | E21B/41/00 |

* cited by examiner

APPARATUS AND METHOD TO COMPLETE A MULTILATERAL JUNCTION

BACKGROUND OF THE INVENTION

1. Field of the Invention

The present invention relates generally to tieback systems for lateral well bores. More specifically, the invention relates to an improved apparatus used in a multilateral completion and a method of obtaining a multilateral completion. The apparatus and method are used to tieback or connect a lateral well that is drilled from a primary well, which may be vertical or deviated, by orienting a tieback assembly at the upper end of a liner in the lateral well bore adjacent a casing window using a key, key slot, no-go device, and bottom edge of the casing window to rotationally and longitudinally locate a tieback liner with respect to the casing window. The tieback liner is then coupled to a guide rail near the casing window. After the tieback liner is installed, the invention provides full bore access in the main well bore while supporting external loads on the tieback liner.

2. Description of Related Art

Lateral well bores are routinely used to more effectively and efficiently access hydrocarbon bearing formations. Typically, lateral well bores are drilled and accessed from a window that is formed in the casing of a central or primary well bore. The casing windows are often preformed at the surface of the well prior to installation of the casing. With the window formed, the lateral well bore is formed with a drill bit and drill string. Thereafter, the liner is run into the lateral well bore and "tied back" to the main well bore. This allows, for example, collection of hydrocarbons from the lateral well bore.

Lateral tieback systems are well known. Various types are in use, including hanger type systems that allow a lateral liner to be mechanically tied back to the main casing at the window opening with the tieback means extending at least partially into the primary well bore, thus reducing the diameter of the main casing. Flush mount systems currently available place the liner in the main casing then "chop off" the portion of the liner that extends up into the main casing.

Still other systems available utilize some form of liner hanger device placed in the main casing to connect the liner in the lateral well bore to the primary well bore. Some examples of lateral tieback systems are detailed in U.S. Pat. Nos. 5,944,108, 5,477,925, and 6,079,488, and those patents are incorporated herein by reference in their entirety. The "hook" liner hanger systems of the first two aforementioned patents utilize a pair of longitudinal lateral extensions (hooks) along the outside of a liner. The liner is inserted into a lateral well bore through a window formed in the main well bore casing until the hooks locate on the bottom edge of the window. The liner is then set in place to connect the lateral and primary well bores. However, in each of these systems, the liner extends significantly into the primary well bore and significantly restricts the internal diameter of the main casing.

Some hanger type systems do not adequately support external loads on the tieback liner, especially loads applied perpendicular to the liner, and do not prevent the liner from being pushed back into the main well bore casing.

There are other problems with currently available tieback systems. Systems that sever a section of the liner extending into the primary well bore require a milling process which is time consuming and expensive, always carries the risk of loss of the entire well bore during the installation process, and reduces the capacity to hold formation load. Existing liner hanger systems that use a permanent orientation device mounted in the main well bore to orient the liner window to the main casing take up space and may significantly reduce the internal diameters of both the lateral well bore liner as well as the main casing.

There is a need, therefore, for a tieback apparatus and method to complete a multilateral junction that will overcome the shortcomings of the prior art devices. There is a further need for a tieback apparatus that can be installed in new well bores that does not restrict the internal diameter of the primary well bore.

There is a further need, therefore, for a tieback system that more effectively facilitates the placement and hanging of a liner in a lateral well bore. There is a further need for a tieback system that can be mechanically oriented. There is yet a further need for a tieback system that can be rotationally and longitudinally located in a primary well bore using a key slot as a guide. There is yet a further need for a tieback system that can be placed in a well bore while minimizing the obstructions in the liner or the primary well bore casing after installation.

There is yet a further need for a tieback system that can maintain the position of the liner with respect to the main well bore casing as well as a need for a system that can support external loads applied to the liner.

There is yet a further need for a tieback system that can be cemented in a well bore and allows full casing access through the junction without restriction and which does not require any downhole milling of the liner with the accompanying generation of steel cuttings which can cause numerous problems like the sticking of drilling and completion tools.

BRIEF SUMMARY OF THE INVENTION

The present invention provides an apparatus and method to complete a lateral well bore. The invention provides the ability to locate the lateral well bore and connect it with the primary well bore using a tieback liner. Once the tieback liner is installed, the invention provides for the cementing of the junction. In addition, the invention does not restrict the internal diameters of the tieback liner or the primary well bore and permits full access to both the lateral and primary well bores below the junction. The liner maintains full bore access while supporting external loads applied to the liner from the surrounding formation.

In a preferred embodiment, the invention includes a primary well bore insert that includes a key slot for rotational orientation of the installation of a tieback liner, a lateral window for drilling and accessing the lateral well bore, a coupling stock having an inner diameter greater than the inner diameter of the main casing, and a guide rail. The tieback liner includes a snap sleeve which extends into the coupling stock to connect with the guide rail while providing full bore access in the primary well bore casing. The snap sleeve/guide rail connection prevents the tieback liner from rotating, tilting, or being pushed into the primary well bore insert and supports external loads applied to the liner.

DETAILED DESCRIPTION OF THE INVENTION

Figure 1:
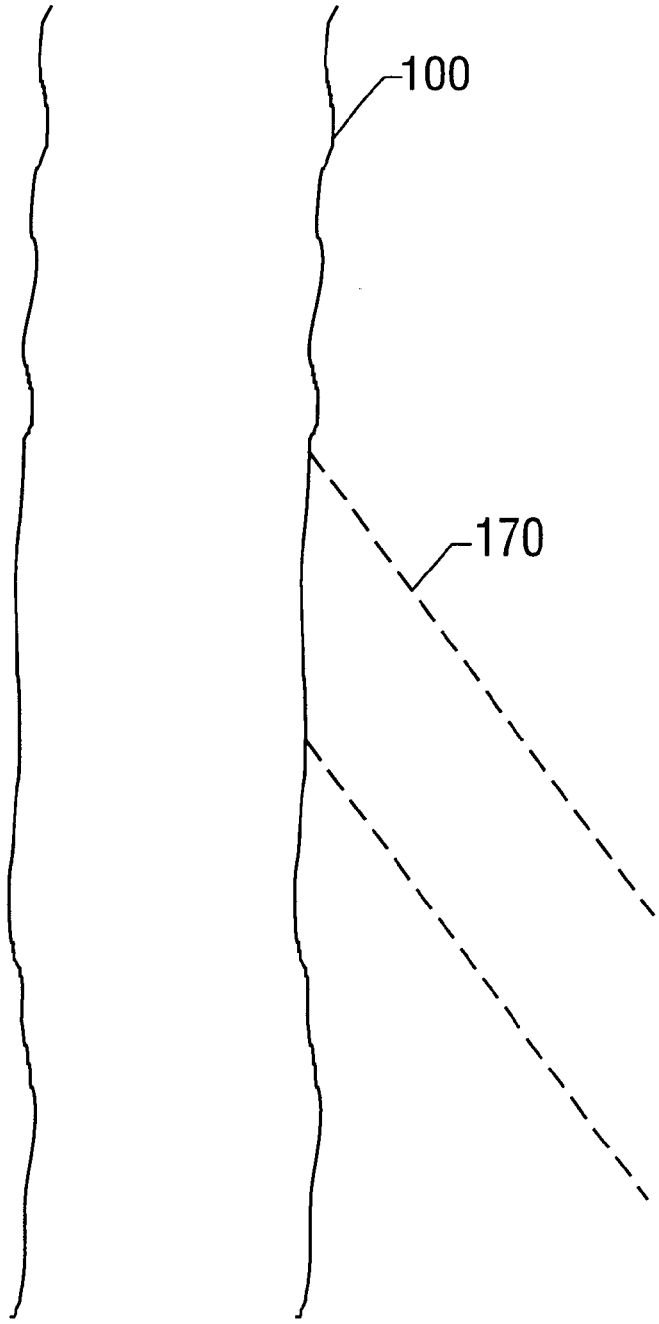
FIG. 1 is a cross sectional view of a portion of a primary well bore where a future lateral well bore is desired.

FIG. 1 is a cross sectional view of a portion of a primary well bore 100 where a future lateral well bore 170 is desired.

Figure 2:
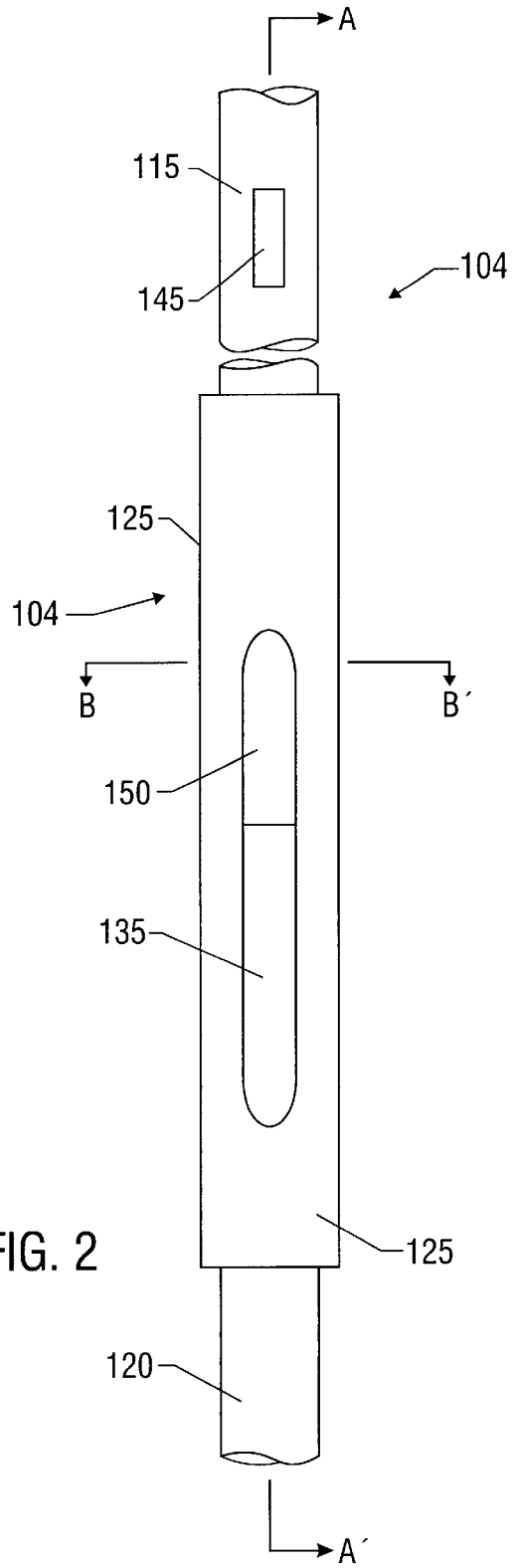
FIG. 2 is a side view of a primary well bore insert.

FIG. 2 is a side view of a primary well bore insert 14for deployment into the primary well bore 100. The insert 104 comprises an upper section of casing 115, a lower section of casing 120, and a coupling stock 125 interposed between the upper and lower sections of casing 115, 120. The coupling stock 125 is attached to the upper casing 115 and lower casing 120. This can be accomplished via threaded connections (not shown). Once the threaded connections are made, the coupling stock 125 is welded (or otherwise solidly fastened) to the upper and lower casing sections 115, 120 so that the three components will stay in the same position relative to each other when the primary well bore insert 104 is deployed in the well bore 100.

The primary well bore insert 104 further includes a window 135 that will allow access to the lateral well bore 170 when the insert 104 is placed in the correct position in the primary well bore 100. The window 135 may be formed entirely in the coupling stock 125, as shown, or in the coupling stock 125 and lower casing section 120. A key slot 145 is located above the window 135. The key slot 145 may be formed in the coupling stock 125 and/or upper casing section 115. The window 135 and key slot 145 are machined in the insert 104 prior to deployment into the primary well bore 100.

Figure 3:
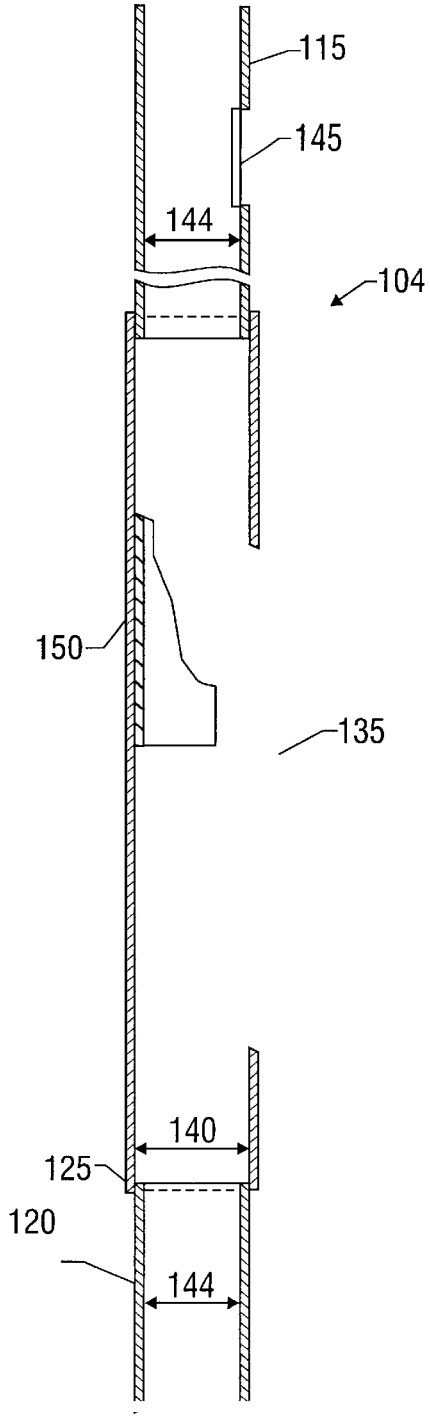
FIG. 3 is a sectional view of the insert taken along line A–A' of FIG. 2
Figure 4:
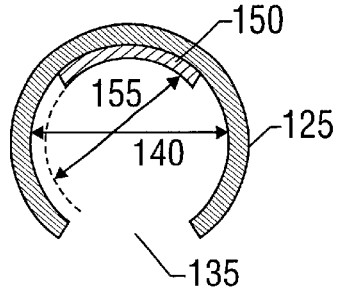
FIG. 4 is an enlarged sectional view of a coupling stock taken along line B–B' of FIG. 2.

FIG. 3 is a sectional view of the insert taken along line A–A' of FIG. 2. Except for the portion including a guide rail 150 (as shown in FIG. 4), the coupling stock 125 has an internal diameter 140 that is larger than the internal diameters 144 of the upper casing 115 and lower casing 120. The guide rail 150 extends vertically along the inside of the coupling stock 125 and is located directly across from the window 135.

FIG. 4 is an enlarged sectional view of the coupling stock 125 taken along line B–B' of FIG. 2. The inner diameter 140 of the coupling stock 125 is constant except where the guide rail 150 is located. The guide rail 150 has an inner diameter 155 (measured as though the guide rail 150 extended around the entire inner circumference of the coupling stock 125) approximately equal to the inner diameters 144 of the upper and lower casing sections 115, 120. As a result, the guide rail 150 does not restrict full bore access when compared to the upper and lower casing sections 115, 120.

To use the current invention, prior to deploying the insert 104 downhole, a window cap (not shown) is connected to the outside of the coupling stock 125 to cover and seal the window 135. The cap has a semi-circular cross section with the curvature of its inside surface approximating that of the outside diameter of the coupling stock 125. The cap also has a length sufficient to cover the entire window 135 and is made of an easily drillable material such as aluminum. The cap is connected to the coupling stock 125 either above or below the window 135 by any mechanical connection that will hold the sleeve in position. Examples include set screws, welding, or brazing. Once in place, the window cap covers the entire window 135 in order to prevent materials, such as cement, from passing through the window 135. The cap has a sealing surface on the inside surface where it contacts the coupling stock 125 around the window 135. This provides pressure integrity to the casing string.

Next, the desired position of a lateral well bore 170 must be determined. The insert 104 is then run into the primary well bore 100 and, using a downhole survey device (such as a steering tool, surface reading gyroscope, or measurement-while-drilling tool), it is positioned such that the window 135 is properly oriented, both axially and longitudinally, with respect to where the lateral wellbore 170 is desired. The primary well bore casing is cemented. The lateral well bore 170 is then drilled from the main well bore 100 through the window 135 of the insert 104 and through the portion of the window cap covering the window 135. This may be accomplished through the use of a whipstock. The cuttings generated by drilling through the window cap do not cause the same problems associated with milling the steel main casing or tieback liners of prior art systems because the cap is made from a relatively soft material.

Figure 5:
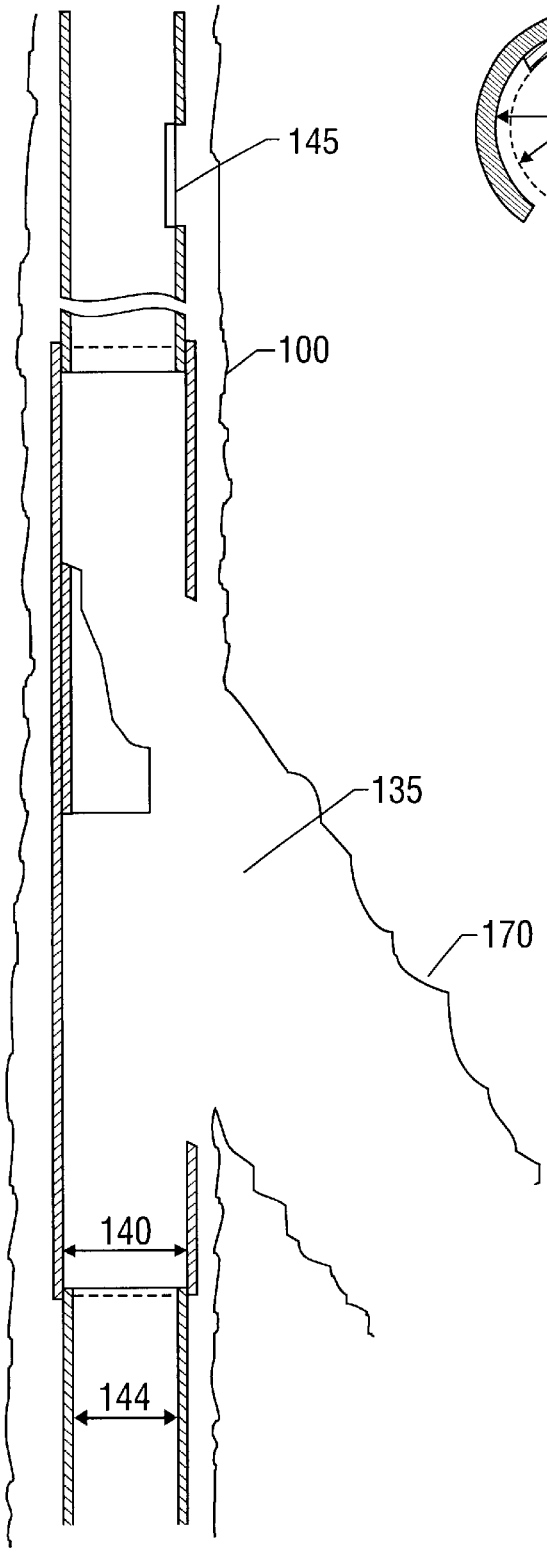
FIG. 5 is a cross sectional view of a properly installed primary well bore insert after the lateral well bore has been drilled.

FIG. 5 is a cross sectional view of a properly installed primary well bore insert 104 after the lateral well bore 170 has been drilled. Note that the key slot 145 is positioned above the lateral well bore 170.

Figure 6:
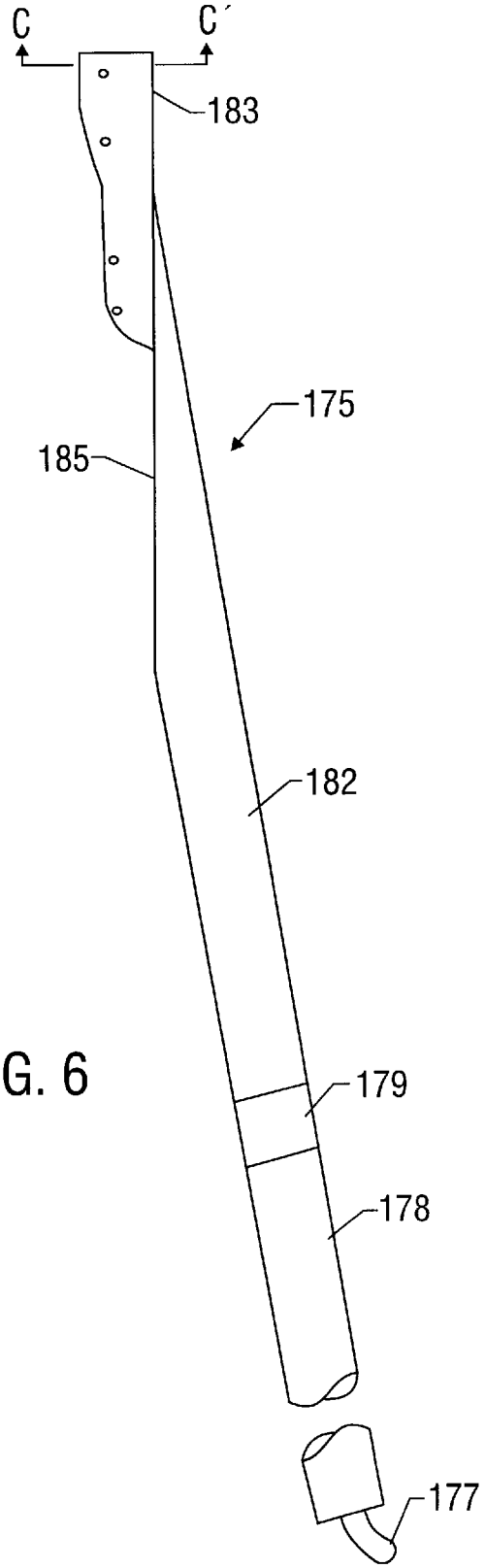
FIG. 6 is a side view of a tieback liner for connecting the lateral well bore to the primary well bore.

FIG. 6 is a side view of a tieback liner 175 for connecting the lateral well bore 170 to the primary well bore 100. The tieback liner 175 includes a bent joint 177 attached to a liner 178, a tieback junction 182, a swivel 179 interposed between the liner 178 and tieback junction 182, and a snap sleeve 183 attached to the end of the tieback junction 182 that is opposite the swivel 179. The swivel 179 allows the bent joint 177 to rotate independently of the tieback junction 182 to facilitate insertion of the bent joint 177 into the lateral well bore 170. In a preferred embodiment, the swivel 179 is a tension swivel that only rotates under a minimum threshold of tension. This allows the liner 178 and bent joint 177 to rotate independently of the tieback junction 182 when upward force is applied to the junction 182. Otherwise, the tension swivel does not rotate and the liner 178 and bent joint 17 in unison with the tieback junction 182. The bent joint 177 is a curved section of tubing designed to be pointed in the direction of the window 135 of the primary well bore insert 104 to facilitate the movement of the tieback junction 182 into the lateral well bore 170 from the primary well bore 100.

The tieback junction 182 includes an opening 185 that is positioned at the window 135 of the primary well bore insert 104 upon installation of the tieback junction 182. The opening 185 is formed at an angle such that it aligns the tieback junction 182 with the window 135 of the insert 104 but does not allow any portion of the tieback junction 182 to extend into and obstruct the internal diameter of the insert 104.

Figure 6A:
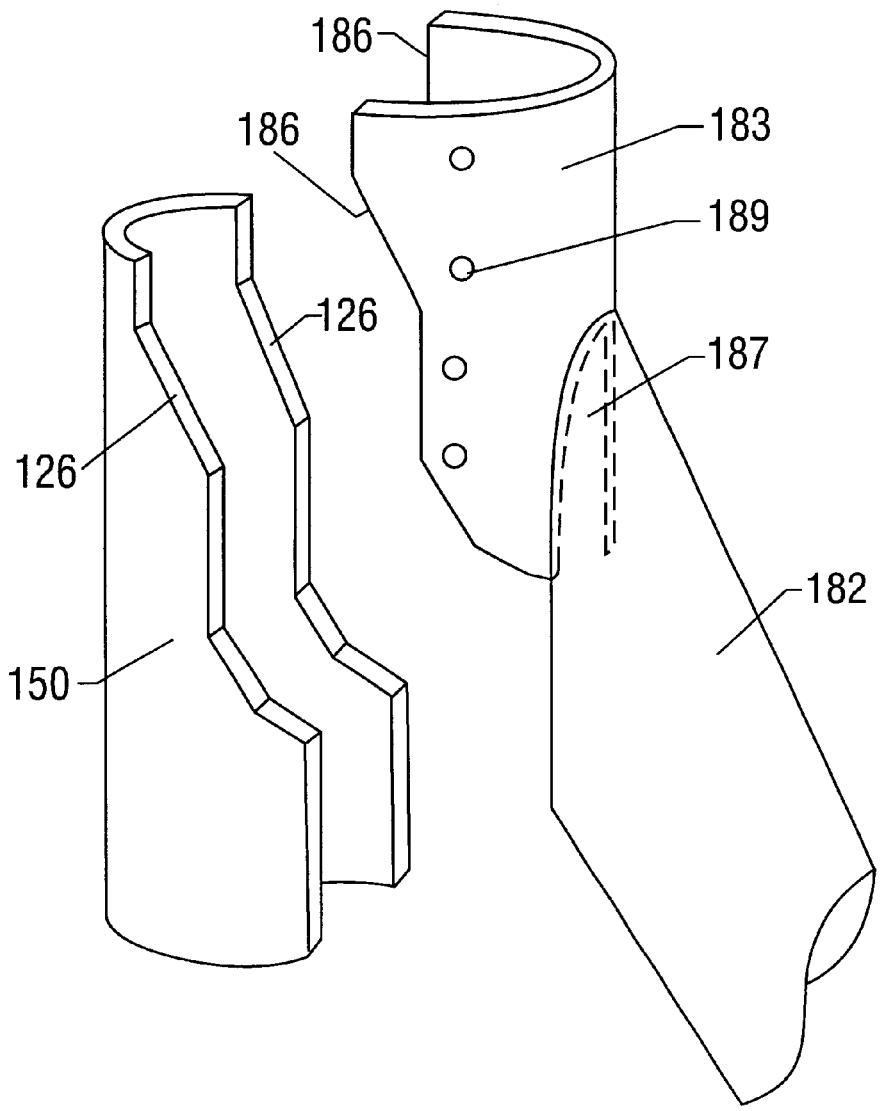
FIG. 6A is an elevational view of a snap sleeve in its expanded state and a guide rail.

FIG. 6A is an elevational view of the snap sleeve 183 in its expanded state (as detailed below) and the guide rail 150. The guide rail 150 is located within the coupling stock 125 of the insert 104, as shown in FIG. 3. The snap sleeve 183 includes mounting surface 186 with a configuration that corresponds to the mounting surface 126 of the guide rail 150. The snap sleeve 183 also includes slots 189 used to attach it to a running assembly 200 (not shown) and an opening 187 that corresponds to a top portion of the opening 185 in the tieback junction 182. The opening 187 is shaped such that it allows full bore access to the tieback junction 182.

Figure 6B:
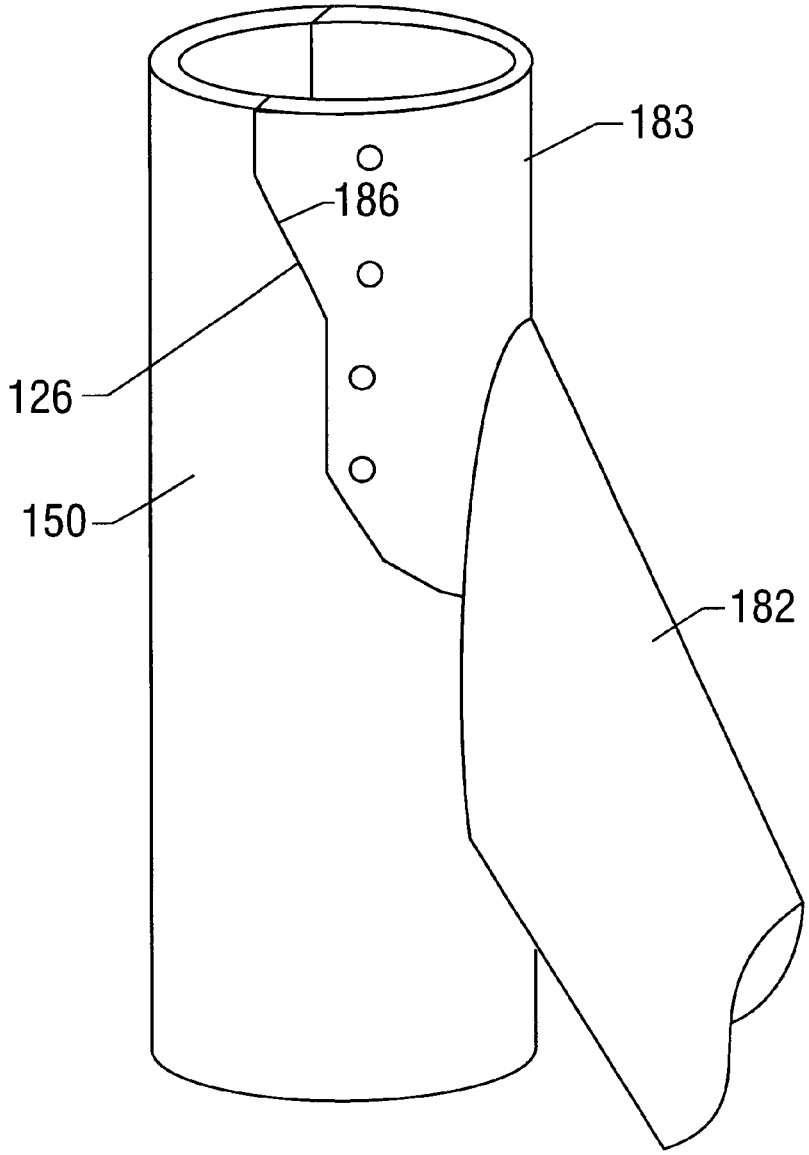
FIG. 6B is an elevational view of the expanded snap sleeve engaged with the guide rail.

FIG. 6B is an elevational view of the expanded snap sleeve 183 engaged with the guide rail 150. The corresponding configuration of the mounting surfaces 186, 126 provides a flush connection between the snap sleeve 183 and guide rail 150, which in turn provides an effective connection between the tieback liner 175 and primary well bore insert 104. This connection prevents the snap sleeve 183 (and the tieback junction 182 attached thereto) from rotating or tilting with respect to the primary well bore insert 104. It also prevents the snap sleeve 183 from being pushed farther into the insert 104, which maintains full bore access in the primary well bore.

Figure 7:
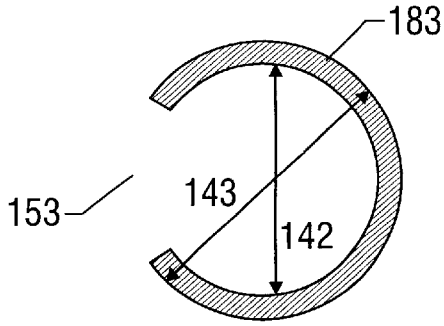
FIG. 7 is an enlarged sectional view of a snap sleeve taken along C–C' of FIG. 6.

FIG. 7 is an enlarged sectional view of the snap sleeve 183 taken along C–C' of FIG. 6. The snap sleeve 183 also has an inner diameter 142 and outer diameter 143. In its original state and prior to being deployed downhole, the snap sleeve's 183 inner and outer diameters 142, 143 are approximately equal to those of the primary well bore casing 188 (not shown). In a preferred embodiment, the snap sleeve 183 is manufactured from the same type of tubing as the primary well bore casing 188. In this original uncompressed state, the snap sleeve 183 cannot fit into the primary well bore casing 188. However, an opening 153 in the snap sleeve 183 makes it a partial ring, which allows the sleeve 183 to be compressed to a smaller diameter in order to fit into the primary well bore casing 188 for being deployed downhole. The opening 153 also allows the snap sleeve 183 to later be expanded to a larger diameter.

FIGS. 8–17 illustrate a preferred method for installing the tieback liner 175 into the primary well bore insert 104 after the insert 104 has been installed downhole and the lateral well bore has been drilled (as shown in FIG. 5).

Figure 8:
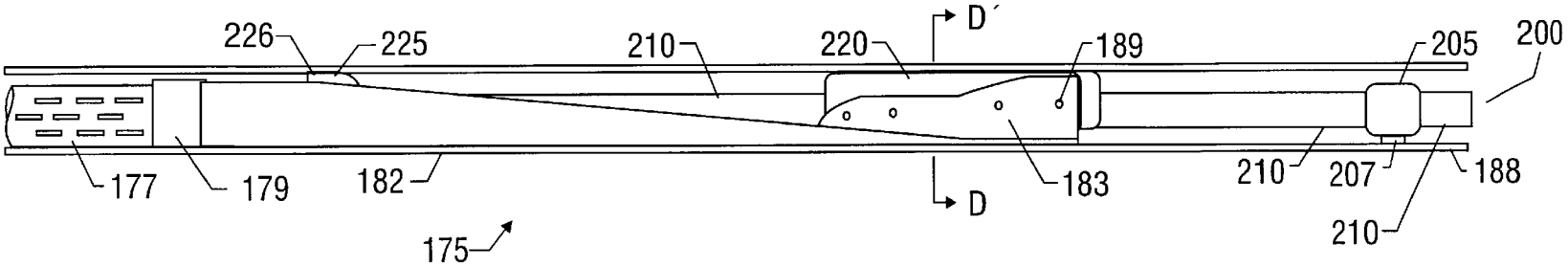
FIG. 8 is a side view of the tieback liner after deployment into a primary well bore casing above the primary well bore insert.

FIG. 8 is a side view of the tieback liner 175 during deployment into the primary well bore casing 188 above the primary well bore insert 104 (not shown). The running assembly 200 is used to carry the tieback liner 175 downward into the casing 188. The running assembly 200 includes an orienting keysub 205, hydraulically activated sleeve 215 (see FIG. 9), holding sleeve 220, a spring loaded no-go device 225, and tubing 210 interposed between the surface and keysub 205, between the keysub 205 and sleeves 215, 220, and between the sleeves 215, 220 and no-go device 225.

The orienting keysub 205 includes a spring loaded key 207. As shown, the key 207 is compressed by the casing 188, with at least a portion of the key 207 being recessed in a housing formed in the keysub 205. The key 207 is spring loaded to prevent interference between the key 207 and the wall of the casing 188 as the running assembly 200 is deployed.

The no-go device 225 includes an obstruction 226 that is spring loaded and remains at least partially recessed in a housing formed by the tieback liner 175 until exposed by the tieback liner 175 moving into the lateral well bore 170. In another embodiment, a simple mechanical linkage runs between the key 207 and the no-go device 225 whereby the no-go device 225 is released only upon engagement of the key 207 in the key slot 145. In yet another embodiment, the no-go device can utilize a fixed obstruction rather than being spring loaded. As shown, the no-go device 225 is in its compressed state.

The tieback liner 175 is held by the running assembly 200, in part, by connecting the snap sleeve 183 to the holding sleeve 220, as explained below.

Figure 9:
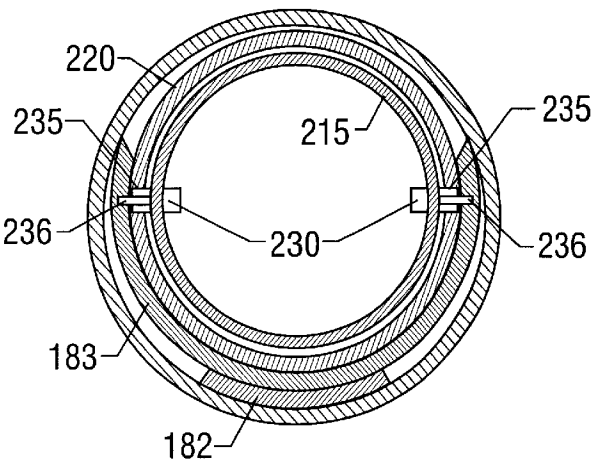
FIG. 9 is an enlarged cross sectional view taken along line D–D' of FIG. 8.

FIG. 9 is an enlarged cross sectional view taken along line D–D' of FIG. 8. The snap sleeve 183 is connected to the holding sleeve 220 prior to deploying the running assembly 200 downhole. This is accomplished by compressing the snap sleeve 183 and placing it onto the holding sleeve 220, as described below. The holding sleeve 220 includes slots 235 that correspond to the slots 189 (see FIG. 8) in the snap sleeve 183. The snap sleeve 183 and holding sleeve 220 are then positioned such that their respective slots 189, 235 are in alignment. Pins 236 are then placed through the slots 189, 235 to connect the snap sleeve 183 to the holding sleeve 220, which in turn connect the tieback liner 175 to the running assembly 200. The pins 236 also maintain the snap sleeve 183 in its compressed state, which also allows the snap sleeve 183 to fit within the primary well bore casing 188.

The running assembly 200 also includes expansion lugs 230 that extend from the inside of the hydraulically activated sleeve 215, through the hydraulic sleeve 215 and holding sleeve 220, to the inner surface of the snap sleeve 183.

Figure 10:
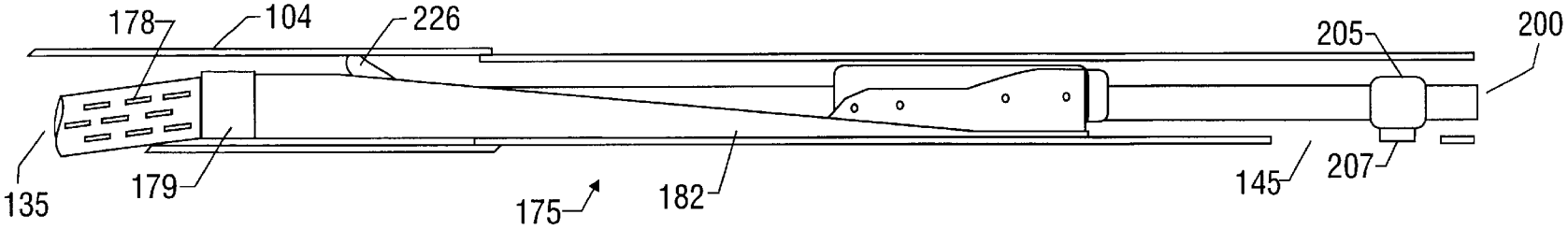
FIG. 10 is a side view of a running assembly and the tieback liner after the tieback liner has been rotationally aligned with respect to the lateral well bore.

FIG. 10 is a side view of the running assembly 200 and tieback liner 175 after the tieback liner 175 has been rotationally aligned with respect to the lateral well bore 170. This is accomplished by lowering the running assembly 200 and tieback liner 175 in the primary well bore casing. If a tension swivel 179 is used, the swivel 179 is not under sufficient tension to rotate during this step, which allows the liner 178 and bent joint 177 (not shown) to rotate in unison with the running assembly. This in turn facilitates the rotational positioning of the bent joint 177 for feeding into the lateral well bore 170. The bent joint 177 and liner 178 are fed into the lateral well bore 170 through the window 135 in the insert 104 until the depth of the keysub 205 is a short distance above the depth of the key slot 145 formed in the insert. The depth of the key slot 145 may be determined by the length of main well bore casing 188 deployed downhole. The depth of the keysub may be determined by the length of pipe deployed with the running assembly 200 or by a wireline tool that measures the length of main well bore casing 188 through which the running assembly 200 has traveled. The running assembly is then slowly lowered and rotated until an increase in torque resistance is detected. This signifies that that the spring loaded key 207 has extended into the key slot 145 and, as a result, that the tieback liner 175 is rotationally oriented with respect to the window 135 leading to the lateral well bore 170.

Figure 11:
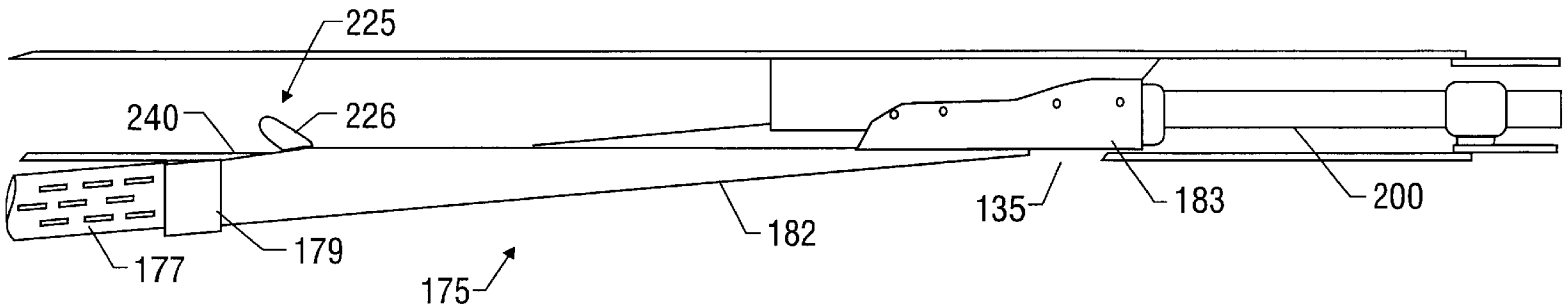
FIG. 11 is a side view of the running assembly and tieback liner lowered until a no-go device prevents farther downhole movement.

The running assembly 200 is then lowered so that the tieback junction 182 is fed into the lateral well bore 170 through the window 135. The obstruction 226 of the spring loaded no-go device 225 is now extended by operation of its spring since it is no longer being held in its compressed state by the upper casing 115 or coupling stock 125. The running assembly 200 is lowered even farther until the obstruction 226 hits a lower edge 240 of the window 135, as shown in FIG. 11. The obstruction 226 prevents farther downhole movement of the assembly 200 and signifies that the tieback liner 175 is longitudinally oriented with respect to the window 135. The running assembly 200 is then lifted up a predetermined distance, preferably about 2 meters, as shown in FIG. 12, so that the snap sleeve 183 can be expanded.

Figure 12:
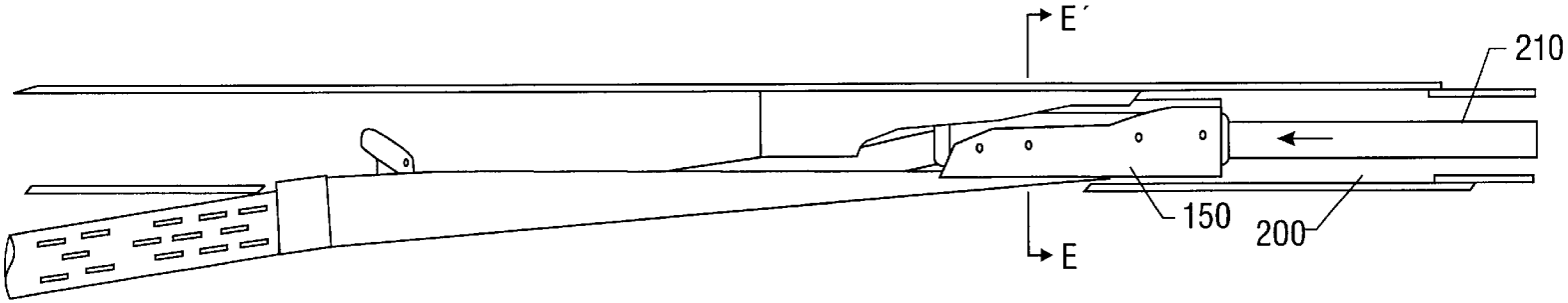
FIG. 12 is a side view of the running assembly and tieback liner after being raised a short distance.
Figure 13:
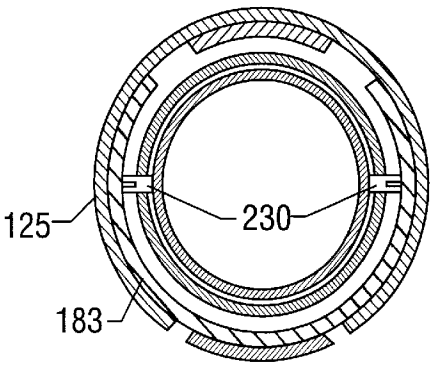
FIG. 13 is an enlarged cross sectional view taken along line E–E' of FIG. 12 showing the snap sleeve in its expanded state.

FIG. 13 is an enlarged cross sectional view taken along line E–E' of FIG. 12 showing the snap sleeve 183 in its expanded state. This is accomplished by applying hydraulic pressure within the tubing 210 sufficient to force the expansion lugs 230 outward. The lugs 230 push against the inner surface of the snap sleeve 183 causing it to expand. Hydraulic pressure is applied until the snap sleeve 183 is fully expanded against the inner surface of the coupling stock 125.

Figure 14:
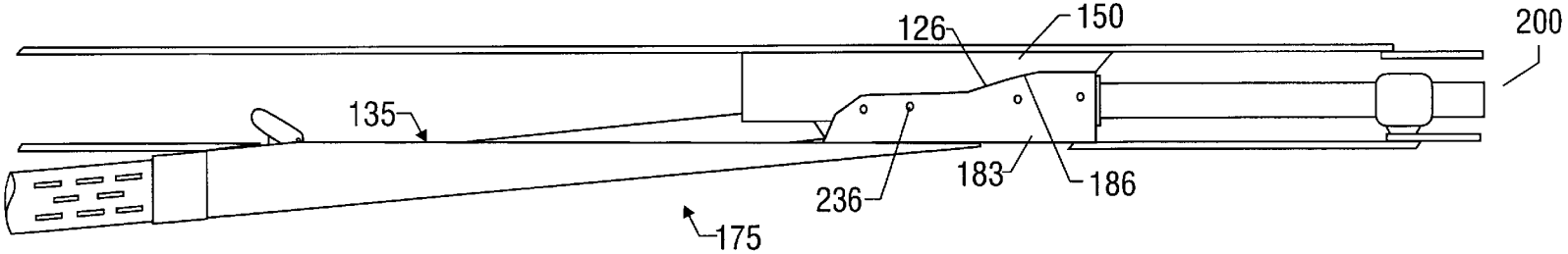
FIG. 14 is a side view of the snap sleeve installed onto a guide rail.

The assembly 200 is then pushed downward until the expanded snap sleeve 183 interlocks with the guide rail 150, as shown in FIG. 14 (see also FIGS. 6A and 6B). The mounting surfaces 126 of the guide rail 150 correspond to the mounting surfaces 186 of the snap sleeve 183, thus locking the tieback liner 175 into a position that orients it towards the window 135 and into the lateral well bore 170 (not shown). Cement is then applied in the annulus outside the insert 104 and tieback liner 175 (not shown). For example, cement can be pumped through the running assembly 200 tubing 210 to the lower end of the liner 178, or through special subs, called port collars, inserted in the liner 178 for this purpose, where it is circulated back up in the annulus between the bore hole and liner 178 and eventually to the annulus surrounding the junction between the tieback liner 175 and insert 104. In a preferred embodiment, the cemented junction forms a Level 4 junction under the Technology Advancement Multi Lateral ("TAML") organization's classification system, which ranges from Level 1 to Level 6.

After cementing is completed, additional downward force is applied to the running assembly to shear the pins 236 that hold the tieback liner 175 to the running assembly 200, thus releasing the tieback liner 175 from the running assembly 200.

Figure 15:
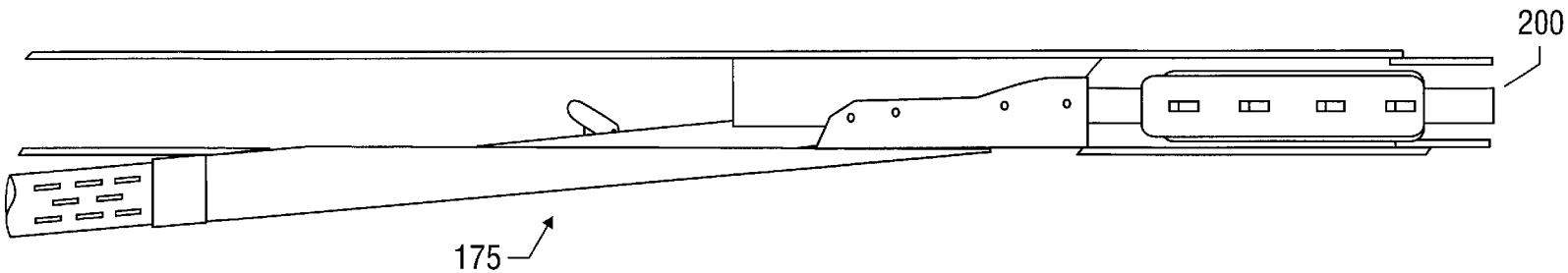
FIG. 15 is a side view of the running assembly being removed.

FIG. 15 is a side view of the running assembly 200 being removed. The running assembly is removed after the tieback liner 175 has been released. The released tieback liner 175 remains downhole, thus connecting the lateral well bore 170 to the primary well bore 100.

Figure 16:
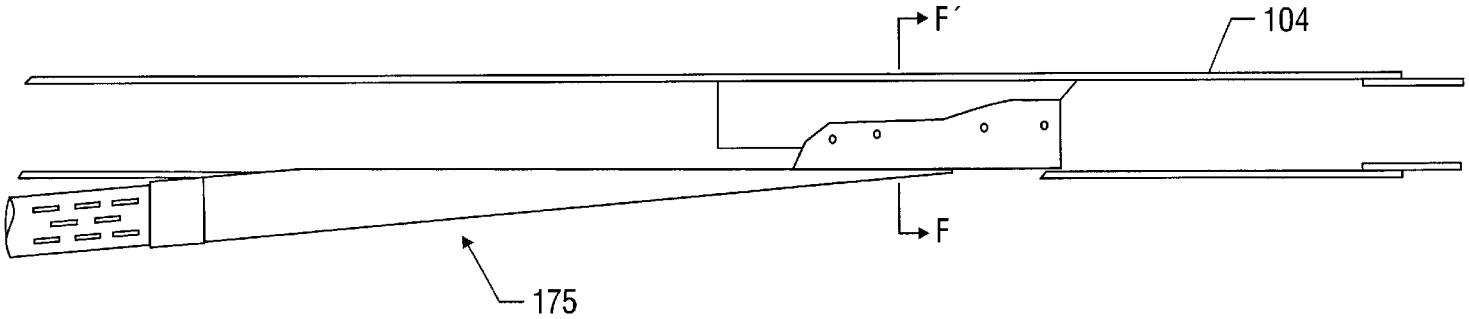
FIG. 16 is a side view of the connected tieback liner and primary well bore insert.

FIG. 16 is a side view of the connected tieback liner 175 and primary well bore insert 104. The primary well bore 100 is connected to the lateral well bore 170, and the running assembly 200 has been removed so that there are no obstructions in the primary or lateral well bore 100, 170.

Figure 17:
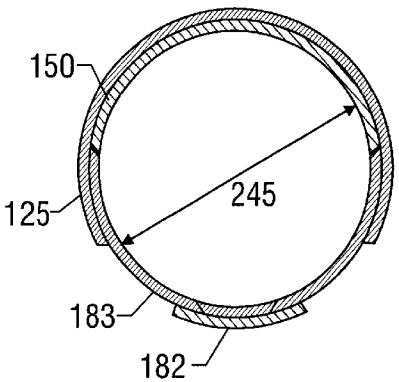
FIG. 17 is an enlarged sectional view of the connected tieback liner and primary well bore insert taken along line F–F'.

FIG. 17 is an enlarged sectional view of the connected tieback liner 175 and primary well bore insert 104 taken along line F–F'. The expanded snap sleeve 183 and guide rail 150 have an inner diameter 245 equal to the inner diameter 144 of the upper and lower casing sections 115, 120 (not shown). Thus, once the snap sleeve 183 is in place, it allows full bore access of the primary well bore 100 because the snap sleeve 183 and guide rail 150 do not obstruct the normal interior diameter 144 of the primary well bore casings 115, 120. Also, the connection between the snap sleeve 183 and guide rail 150 extends along the inside circumference of the coupling stock 125, which prevents the tieback liner 175 from rotating or tilting with respect to the primary well bore. The connection also prevents the tieback junction 182 from being pushed into the insert 104.

Several benefits are achieved by this invention. The invention provides a mechanism and method to mechanically orient a tieback liner with respect a lateral well bore. Once oriented, the invention provides a connection between the lateral well bore and primary well bore that does not restrict full bore access in the primary well bore or lateral well bore casings. This is accomplished in part by utilizing a coupling stock 125 having an inner diameter 140 greater than the inner diameter 144 of the primary well bore casing, which creates space for a connecting mechanism (snap sleeve 183 and guide rail 150) that does not decrease the inner diameter of the primary well bore casing. Full bore access is further maintained by not extending any portion of the tieback junction 182 into the primary well bore 100. This invention further allows the junction between the main casing and this tieback liner 175 to be cemented into place. The invention avoids hanging the weight of the tieback liner 175 on the window 135 of the primary well bore casing, and also provides a connection that prevents the tieback liner 175 from rotating or tilting with respect to the primary well bore casing 188. The connection also prevents the tieback junction 182 from being pushed into the primary well bore casing. This type of connection also allows the invention to support external loads on the tieback liner 175. All of these benefits are accomplished without any downhole milling during the setting of the tieback liner 175, which generates steel cuttings, or the use of a permanent orientation device, which reduces the inner diameter of the casing.

What is claimed is:

1. An apparatus for connecting a main well bore and a lateral well bore comprising:

a primary well bore insert comprising:

an upper casing having an inside diameter;

a lower casing;

a lateral opening formed below the upper casing;

a key slot formed above the lateral opening; and a coupling stock between the upper and lower casings having an inner diameter greater than the inner diameter of the upper casing, wherein the coupling stock comprises a guide rail opposite the lateral opening extending longitudinally on an inner surface of the coupling stock, the guide rail having a mounting surface of a predetermined configuration; and a tieback liner comprising:

a bent joint;

a liner attached to the bent joint for extending into the lateral well bore;

a tieback junction having an opening configured to correspond to the lateral opening in the tubular insert;

a swivel interposed between the liner and the tieback junction, said swivel being attached to an end of the liner opposite the end attached to the bent joint; and a snap sleeve for engagement with the guide rail and the inner surface of the coupling stock, the snap sleeve being attached to an end of the tieback junction opposite the end attached to the swivel and comprising:

a mounting surface having a configuration corresponding to the predetermined configuration of the guide rail mounting surface, an outer diameter equal to the inner diameter of the coupling stock, an inner diameter not less than the inner diameter of the upper casing, and a lateral opening configured to correspond to a portion of the liner opening.

2. The apparatus of claim 1, wherein the lower casing includes an inner diameter less than the inner diameter of the coupling stock but greater than or equal to the inner diameter of the upper casing.

3. The apparatus of claim 1, wherein the key slot is formed in the upper casing.

4. The apparatus of claim 1, wherein the key slot is formed in the upper casing and coupling stock.

5. The apparatus of claim 1, wherein the lateral opening is formed in the coupling stock.

6. The apparatus of claim 1, wherein the lateral opening is formed in the coupling stock and lower casing.

7. The apparatus of claim 1, wherein the snap sleeve includes slots for engagement on a running assembly.

8. The apparatus of claim 1, wherein the apparatus further comprises cement around an outer surface of a junction formed by the tieback liner and tubular insert when the snap sleeve is engaged with the guide rail.

9. A method for connecting a lateral well bore and a main well bore comprising:

drilling the main well bore;

determining a location in the main well bore where the lateral well bore is desired;

delivering a primary well bore insert into the main well bore, said primary well bore insert comprising:

an upper casing having an inside diameter;

a lower casing;

a lateral opening formed below the upper casing;

a key slot formed above the lateral opening; and a coupling stock between the upper and lower casings having an inner diameter greater than the inner diameter of the upper casing, wherein the coupling stock comprises a guide rail opposite the lateral opening extending longitudinally on an inner surface of the coupling stock, the guide rail having a mounting surface of a predetermined configuration;

orienting the lateral opening of the tubular insert with the desired location of the lateral well bore;

drilling the lateral wellbore through the lateral opening of the tubular insert to form the lateral well bore;

delivering a running assembly engaged with a tieback liner into the main well bore, said tieback liner comprising a bent joint;

a liner attached to the bent joint for extending into the lateral well bore;

a tieback junction having an opening configured to correspond to the lateral opening in the tubular insert;

a swivel interposed between the liner and the tieback junction, said swivel being attached to an end of the liner opposite the end attached to the bent joint; and a snap sleeve for engagement with the guide rail and the inner surface of the coupling stock, the snap sleeve being attached to an end of the tieback junction opposite the end attached to the swivel and comprising:

a mounting surface having a configuration corresponding to the predetermined configuration of the guide rail mounting surface, an outer diameter equal to the inner diameter of the coupling stock, an inner diameter not less than the inner diameter of the upper casing, and a lateral opening configured to correspond to a portion of the tieback junction opening;

positioning a key in the running assembly proximate the key slot;

rotate the running assembly and the tieback liner until the key is in communication with the key slot;

lowering the running assembly and tieback liner until a no-go device on the running assembly contacts a lower edge of the lateral opening;

raising the running assembly and the tieback liner a predetermined distance;

expanding the snap sleeve to an outer diameter equal to the inner diameter of the coupling stock;

lowering the tieback liner until the snap sleeve engages the guide rail;

cementing an annulus between the main well bore and tubular insert and an annulus between the lateral well bore and tieback liner;

disengaging the running assembly from the tieback liner; and removing the running assembly from the main well bore.

10. The method of claim 9, wherein the lower casing includes an inner diameter less than the inner diameter of the coupling stock but greater than or equal to the inner diameter of the upper casing.

11. The method of claim 9, wherein the key slot is formed in the upper casing.

12. The method of claim 9, wherein the key slot is formed in the upper casing and coupling stock.

13. The method of claim 9, wherein the lateral opening is formed in the coupling stock.

14. The method of claim 9, wherein the lateral opening is formed in the coupling stock and lower casing.

15. The method of claim 9, wherein the running assembly includes expansion lugs for expanding the inner diameter of the snap sleeve.

16. The method of claim 9, wherein the expansion lugs are actuated by hydraulic force.

17. The method of claim 9, wherein the snap sleeve includes slots for engagement on the running assembly.

18. The method of claim 17, wherein the running assembly includes a holding sleeve for engagement with the snap sleeve, said holding sleeve including slots corresponding to the snap sleeve slots.

19. The method of claim 18, wherein pins are inserted through the slots in the holding sleeve and snap sleeve.

20. The method of claim 19, where in the running assembly is disengaged from the tieback liner by shearing the pins.

21. The method of claim 9, wherein the running assembly includes a hydraulically activated sleeve.

22. The method of claim 9, wherein the key is spring loaded.

23. The method of claim 9, wherein the no-go device is spring loaded.

24. The method of claim 9, wherein the cementing is accomplished by pumping cement through the liner of the tieback liner, into an annulus between the liner and the lateral wellbore, and into an annulus between e main and lateral well bores and tubular insert and tieback liner.

25. The method of claim 24, wherein the cementing around the connection of the tubular insert and tieback liner represents a Level 4 category junction under the Technology Advancement Multi Lateral ("TAML") organization's classification system.

* * * * *